US005401384A

United States Patent [19]

Martinez et al.

[11] Patent Number: 5,401,384

[45] Date of Patent: Mar. 28, 1995

[54] ANTIMONY AND TIN CONTAINING COMPOUND, USE OF SUCH A COMPOUND AS A PASSIVATING AGENT, AND PROCESS FOR PREPARING SUCH A COMPOUND

[75] Inventors: Nelson Martinez, San Antoino; Juan Lujano, Caracas; Nieves Alvarez, Caracas; Jacek Lubinkowski, Caracas, all of Venezuela; William McEwen, Amherst, Mass.

[73] Assignees: Inteven, S.A.; Universidad Simon Bolivar, Caracas, Venezuela

[21] Appl. No.: 170,004

[22] Filed: Dec. 17, 1993

[51] Int. Cl.[6] ..... C10G 11/05; C10G 11/18; B01J 29/06

[52] U.S. Cl. ..... 208/52 CT; 208/121; 502/64; 502/521; 556/30; 556/76; 556/88

[58] Field of Search ..... 556/30, 76, 88; 208/52 CT, 121; 502/64, 521

[56] References Cited

U.S. PATENT DOCUMENTS

| | | | |
|---|---|---|---|
| 4,466,884 | 8/1984 | Occelli et al. | 208/120 |
| 4,483,765 | 11/1984 | Payne | 208/120 |
| 4,889,617 | 12/1989 | English | 208/121 |
| 4,954,244 | 9/1990 | Fu et al. | 208/120 |
| 4,986,896 | 1/1991 | Avidan et al. | 208/52 CT |
| 5,064,524 | 11/1991 | Forester | 208/121 |

FOREIGN PATENT DOCUMENTS 1194414 6/1970 Germany .

*Primary Examiner*—José G. Dees
*Assistant Examiner*—Porfirio Nazario-Gonzalez
*Attorney, Agent, or Firm*—Bachman & LaPointe

[57] ABSTRACT

An antimony and tin containing compound for passivating contaminant metals to which a catalyst is exposed during fluid catalytic cracking of hydrocarbons containing said contaminant metals, said compound having a composition as follows $(R^*)_xSb(OSn(R^{**})_3)_n$ wherein R* and R** are aryl compounds having between 6 to 13 carbon atoms, wherein n=1, 2 or 3 and x=4 when n=1, x=3 when n=2, and x=0 when n=3.

28 Claims, No Drawings

ANTIMONY AND TIN CONTAINING COMPOUND, USE OF SUCH A COMPOUND AS A PASSIVATING AGENT, AND PROCESS FOR PREPARING SUCH A COMPOUND

BACKGROUND OF THE INVENTION

The invention relates to the field of fluid catalytic cracking of hydrocarbons, especially heavy hydrocarbons, containing contaminant metals and, more particularly, to a compound for passivating such contaminant metals.

Fluid catalytic cracking is a frequently used process for cracking heavy hydrocarbon feedstocks into lighter, more useful fractions and especially into gasoline.

Catalysts used for such processes are of numerous types and include zeolite type catalysts of both natural and synthetic origin. Zeolite catalysts are characterized by crystalline aluminosilicate structure which serves as a molecular sieve and active compound to yield the desired cracking activity and products. The effectiveness of the zeolite catalyst is greatly diminished, however, when certain contaminant metals are present in the feedstock. Of particular significance as contaminant are nickel, vanadium, iron, copper and chromium. These metals are deposited upon the catalyst during cracking and significantly interfere with the function of the catalyst to obtain desired cracking products.

Passivation is a procedure which is used to reduce the adverse effects of contaminant metals in the feedstock. This technique involves the introduction of reactants into the feedstock or catalyst which interact with the contaminant metal and render same inert so as to protect the catalyst from the harmful effects of such contaminants.

Antimony and tin are known passivating agents and are useful for passivating nickel and vanadium respectively.

U.S. Pat. No. 4,321,129 to Bertus et al deals with the use of antimony and tin to regenerate activity in used catalysts. Bertus et al. teach the treating of such a used FCC catalyst individually with antimony compounds and then with tin compounds so as to passivate contaminant metals. The catalyst is impregnated with each compound separately. Further, Bertus et al. teach the use of antimony compounds and tin compounds which include other contaminants such as sulfur and phosphorus.

U.S. Pat. No. 4,466,884 to Occelli et al. also teaches the use of antimony and tin to passivate contaminant metals. As with Bertus et al., antimony and tin are used in separate compounds that each include additional contaminants such as sulphur and phosphorus. Further, Occelli et al. report the use of titanium, aluminum and calcium oxide containing compounds as diluents for the tin and antimony. However, titanium, aluminum and calcium oxides are reported to be passivating agents. See for example U.S. Pat. Nos. 4,816,135, 4,704,375, and 4,432,890. Thus the improved results of Occelli et al. are no doubt at least partially due to the use of additional passivating agents.

It is a principal object of the present invention to provide a single compound containing both antimony and tin which compound can be added to a feedstock or can be impregnated into a catalyst to passivate contaminant metals in the feedstock.

It is another object of the present invention to provide a process for preparing an antimony and tin containing compound in accordance with the invention.

It is a further object of the invention to provide such a process and compound wherein the compound is essentially free of sulfur, phosphorous, and other undesirable contaminants.

It is still another object of the present invention to provide a process whereby an antimony and tin containing compound is used to passivate contaminant metals in a feedstock for a fluid catalytic cracking process.

Further objects and advantages of the present invention will appear hereinbelow.

SUMMARY OF THE INVENTION

The invention relates to an antimony and tin containing compound which is useful for passivating contaminant metals contained in a hydrocarbon feedstock to be treated in a fluid catalytic cracking (FCC) procedure. The compound passivates contaminant metals, especially nickel and vanadium, which otherwise would seriously affect the selectivity of the catalyst and the ability of the catalyst to effectively crack the hydrocarbon feedstock to the desired valuable products.

According to the invention, the antimony and tin containing compound has a composition as follows:

$$(R^*)_xSb(OSn(R^{**})_3)_n$$

wherein

R* and R** are aryl compounds each having between 6 to 13 carbon atoms, preferably 6 to 11, and more preferably 6 to 10 carbon atoms and wherein n=1, 2 or 3 and wherein x=4 when n=1, x=3 when n=2, and x=0 when n=3.

According to the invention, the process for preparing such an antimony and tin containing compound comprises reacting an antimony containing compound, preferably selected from the group consisting of monohalogen-tetraaryl-antimony, dihalogen-triaryl-antimony, and trihalogen antimony with a triaryl tin hydroxide compound in the presence of an alkylamine catalyst so as to form a reaction mixture containing said antimony and tin containing compound, and crystallizing the desired antimony and tin containing compound from the reaction mixture.

The crystallization process may preferably include the steps of filtering said reaction mixture obtained from said reacting step; concentrating said filtered mixture so as to obtain an oil; dissolving said oil in a heated solvent; and cooling said solution of oil and solvent so as to obtain a crystalline precipitate of said antimony and tin containing compound. The foregoing filtering, concentrating, dissolving and cooling steps are carried out at normal conditions through standard procedures. The actual conditions and/or procedures used during this step are not critical and form no part of the present invention.

The compound of the present invention may preferably be used in an FCC process in a process comprising the steps of providing an antimony and tin containing compound having a composition as follows: $(R^*)_xSb(OSn(R^{**})_3)_n$ wherein R* and R** are aryl compounds each having between 6 to 13 carbon atoms, preferably 6 to 11, and more preferably 6 to 10 carbon atoms and wherein n=1, 2 or 3 and x=4 when n=1, x=3 when n=2, and x=0 when n=3; providing a fluid catalytic cracking catalyst; providing a hydrocarbon feedstock containing contaminant metals; and treating said feedstock with said catalyst in the presence of said compound while maintaining a molar ratio of antimony and tin to contaminant metal of between about 0.01 to about 10.0. The amount of compound to be used is selected so as to provide a desired molar ratio of metal (antimony and tin) to contaminant. The molar ratio of antimony to contaminant metal may preferably be maintained between about 0.1 to 2.0 or may preferably be maintained between about 0.1 to 1.0.

DETAILED DESCRIPTION

The invention relates to the field of fluid catalytic cracking (FCC) of heavy hydrocarbons. Such heavy hydrocarbons frequently contain contaminant metals such as nickel, vanadium, iron, copper, chromium and mixtures thereof. These contaminant metals tend to adversely effect the catalyst used during the FCC procedure, thereby reducing the fractions of desired products obtained.

The foregoing contaminant metals react with or deposit on the catalyst and adversely affect or inhibit the molecular sieve function of the catalyst, thereby reducing the fraction of gasoline obtained, and increasing the fraction of undesirable products such as coke or dry gas ($C_1$, $C_2$).

According to the invention an antimony and tin containing compound is provided which is added to the feedstock being treated or impregnated into the FCC catalyst so as to passivate contaminant metals contained in the feedstock and thereby preserve the ability of the FCC catalyst to produce large fractions of desirable products such as gasoline.

According to the invention, the antimony and tin containing compound has a composition as follows:

$$(R^*)_x Sb(OSn(R^{**})_3)_n$$

wherein

R* and R** are aryl compounds having from between 6 to 13 carbon atoms, preferably 6 to 11, and more preferably 6 to 10 carbon atoms. R* and R** may be the same compound or they may be different. R* and R** are preferably phenyl. In the above relation, n=1, 2 or 3, and x=4 when n=1, x=3 when n=2, and x=0 when n=3.

Compounds according to the invention are prepared by reacting an antimony containing compound with a triaryl tin hydroxide compound in the presence of an alkylamine which serves as a catalyst for the reaction.

The antimony-containing compound is preferably selected from the group consisting of monohalogen-tetraaryl-antimony, dihalogen-triaryl antimony, and trihalogen-antimony. The halogen may be any member of the halogen group such as bromine, chlorine, fluorine and the like. The aryl group is preferably phenyl ($C_6$) but, as set forth above, may have a higher carbon number up to 13, preferably no greater than 11, and more preferably still no greater than 10. The selection of starting antimony-containing compound is preferably made corresponding to the desired end product in that the number of aryl groups in the antimony-containing compound influences the value of x in the final compound. Thus, if x is to be 4, then monohalogen-tetraaryl-antimony should be used. If x is to be 3, then dihalogen-triaryl-antimony is used. If x is to be 0, then trihalogen-antimony is appropriate.

The triaryl tin hydroxide compound may also include an aryl group as set forth above, having at least 6 and up to 13, preferably 11, and more preferably up to a maximum of 10 carbon atoms. The preferable compound is triphenyl tin hydroxide.

The alkylamine catalyst may of course be any effective alkylamine. The preferred catalyst is triethylamine which is added in small amounts effective to expedite the reaction between the respective tin and antimony containing starting materials so as to provide the desired antimony-tin compound.

The reacting step may preferably be carried out by providing solutions of the antimony-containing compound and the triaryl tin hydroxide compound in organic solvent, mixing the solutions, adding the alkylamine catalyst to the mixture of solutions, and allowing the mixture of solutions and catalyst to sit for a period of time while the reaction proceeds, thereby providing a reaction mixture containing the antimony-tin compound of the invention, which mixture can be further treated, preferably crystallized, to obtain the compound in a desired crystalline form.

The desired form of the antimony and tin containing compound of the present invention may be obtained by filtering the reaction mixture obtained from the above reaction to obtain a filtrate. The filtering step removes alkylamine and halogen by-products of the reaction. The resulting filtrate is then preferably concentrated to provide an oil which is then dissolved into a heated solvent. The solution of oil and solvent is then cooled so as to obtain a crystalline precipitate of the desired antimony and tin containing compound. The compound of the present invention has a melting point of between about 70° C. to 180° C.

Antimony and tin containing compounds of the present invention may be used to passivate contaminant metals of a feedstock by mixing the compound with the hydrocarbon feedstock prior to the FCC procedure or by impregnating the compound into the FCC catalyst in amounts providing a molar ratio of total antimony and tin in the compound to contaminant metals in the feedstock of between about 0.01 to 10.0. The ratio of antimony to contaminant metal may preferably be maintained at between about 0.1 to 2.0, while the molar ratio of tin to contaminant metal may preferably be maintained at between about 0.1 to 1.0. These ratios may preferably be adjusted by controlling the amount of compound used with respect to the nickel and/or vanadium content in the hydrocarbon feedstock.

The compound is effective as a passivating agent for contaminant metals including nickel, vanadium, iron, copper, chromium and mixtures thereof, and preferably is used for passivating nickel and vanadium.

When the contaminant metals are predominantly nickel and vanadium, the compound is preferably provided so that a ratio of antimony to nickel is maintained at between about 0.1 to 2.0, preferably between about 0.2 to 2.0, while a ratio of tin to vanadium is maintained at between about 0.1 to 1.0, preferably between about 0.2 to 0.9, and most preferably between about 0.3 to 0.8. These ratios, as above, may suitably be adjusted by altering the amount of compound to be used with respect to the nickel and/or vanadium in the feedstock. The appropriate ratio as set forth above may be selected based upon the predominant contaminant metal.

The compound of the present invention is effective for use with feedstocks having between about 0.1 to about 50 ppm of contaminant metal.

The FCC catalyst is preferably a zeolite type catalyst, either naturally occurring or synthesized, such as the well known ZSM types, X and Y type synthetic faujasite, $\beta$-zeolite and the like.

In use the compound of the present invention is preferably either impregnated into the FCC catalyst or mixed directly with the feedstock. In either circumstance, the compound is preferably solubilized prior to being used by mixing the compound with an organic solvent. The organic solvent may be any organic solvent and is preferably selected from the group consisting of benzene, toluene, cyclohexane, furanes, xylenes, and mixtures thereof.

According to an alternate embodiment of the invention, the starting antimony-containing compound is not a halogen compound but rather includes an alkoxide group such as, for example, a methoxy group. The antimony-containing compound according to this embodiment is selected from the group consisting of alkoxy-tetraaryl-antimony, dialkoxy-triaryl-antimony and trialkoxy-antimony. As with the preceding embodiment, selection of the antimony-containing compound influences the product obtained. If x is to be 4, alkoxy-tetraaryl-antimony is used, if x is to be 3, dialkoxy-triaryl-antimony is used, and if x is to be 0, trialkoxy-antimony is used. If dimethoxy-triphenyl-antimony is used (x=3), the reaction according to this embodiment is as follows:

$$(C_6H_5)_3\,Sb(OCH_3)_2+2(C_6H_5)_3\,SnOH\rightarrow(C_6H_5)_3\,Sb\,[OSn(C_6H_5)_3]_2+2CH_3OH$$

Such an alternate process is advantageous as halogen residues in the final product are avoided.

The preparation and use of antimony and tin containing compounds of the present invention will be further illustrated by the following examples.

EXAMPLE 1

This example illustrates the synthesis of an antimony and tin containing compound according to the present invention, where n=2 and x=3. The compound in this example is triphenyl-bis-(triphenyl stanoxi) antimony, that is, $(C_6H_5)_3\,Sb\,[OSn(C_6H_5)_3]_2$.

A volume of 30 ml of 0.053M dibromotriphenyl antimony in anhydrous carbon tetrachloride was mixed with 100 ml of 0.031M triphenyl tin hydroxide in anhydrous carbon tetrachloride. Eight drops of triethylamine ($Et_3N$) were added and the reaction was allowed to proceed for 48 hours. The reaction mixture was then filtered and the filtrate was concentrated until an oil was obtained. The oil was then dissolved in hot benzene and allowed to cool at room temperature until a precipitate was formed. The crystalline precipitate was white in color, and had a melting point between 115° C. and 150° C. The product obtained was characterized by nuclear magnetic resin and spectroscopy and chemical analysis as follows:

Spectral lines NMR in $CDCl_3$ $\delta$=7.3–7.9 (ppm) Analysis for $C_{54}H_{45}SbSn_2O_2$(CALCULATED) (% W) C=59.77; H=4.18; O=2.95; Sn=21.88; Sb=11.22 Analysis found: (% W) C=59.69; H=4.18; Sb=13.14/13.29; Sn=20.77/20.96; O=2.04 (by difference)

The calculated and analyzed values confirm that the compound is in fact $(C_6H_5)_3\,Sb\,[OSn(C_6H_5)_3]_2$.

EXAMPLE 2

This example illustrates another synthesis of the same compound as in Example 1. (i.e. n=2, x=3).

A 1.18M dichloride-triphenyl-antimony solution was prepared by dissolving 50 g of the dichloride in 100ml of methylene chloride solvent. A 0.31M triphenyl tin hydroxide in methylene chloride solution was prepared by dissolving 86.6 g of the hydroxide in 750 ml of methylene chloride solvent.

The dichloride solution was added to the hydroxide solution, followed by the addition of 0.236 moles of triethylamine. The mixture was refluxed for 48 hours, after which the reaction mixture had turned cloudy. The reaction mixture was filtered to remove the triethylamine hydrochloride and the liquid filtrate was concentrated until a viscous oil appeared. The oil was dissolved in 400ml of hot benzene and refluxed for 1 hour. The benzene solution was filtered and the solution concentrated to about 176ml and allowed to settle at room temperature for over 12 hours. The crystals obtained were filtered out, washed with benzene and dried in an Abderhalden apparatus. The crystalline product so obtained had a melting point between 120° C. and 132° C.

EXAMPLE 3

This example illustrates the synthesis of a different antimony and tin containing compound according to the invention wherein n=1 and x=4, that is, the synthesized compound is $(C_6H_5)_4\,Sb\,[OSn(C_6H_5)_3]$.

A 0.0096M tetraphenyl antimony chloride in anhydrous ether solution was prepared by dissolving 1.0 g of the salt in 225 ml of anhydrous ether. A 0.0086M of triphenyl tin in anhydrous ether solution was prepared by dissolving 0.8 g of the hydroxide in 250ml of solvent. Both solutions were mixed and 5 drops of triethylamine was added to the mixture and allowed to settle, at room temperature for 24 hours. After the said time had elapsed, the mixture was filtered and the filtrate was concentrated until an oil was obtained. This oil was dissolved in hot benzene and allowed to cool, at room temperature, obtaining crystals as the temperature decreased. The crystalline product has a melting point between 69° C. and 72° C. NMR($CDCl_3$): $\delta$=7.3 ppm–7.9 ppm (maximum at 7.4).

The reaction is believed to be:

$$(C_6H_5)_4SbCl+(C_6H_5)_3\,Sn\,OH+Et_3N\rightarrow(C_6H_5)_4\,Sb\,[OSn(C_6H_5)_3]+Et_3NH^+Cl^-$$

EXAMPLE 4

This example illustrates the synthesis of another antimony and tin containing compound according to the invention, where n=3 and x=0, that is, the compound is $Sb\,[OSn(C_6H_5)_3]_3$.

A 0.438M trichloro-antimony in anhydrous ether solution was prepared by dissolving in 5 ml of the solvent 0.5 g of the compound. This solution was added to 300 ml of a 0.022M triphenyl tin hydroxide in anhydrous ether solution. The mixture was stirred for 30 hours until a grey precipitate was observed. The mixture was filtered and 0.0065 moles of triethylamine was added to the etheric filtrate followed by stirring for another 30 hours. A precipitate formed and the mixture was filtered. The filtrate was allowed to evaporate at room temperature obtaining white needle form crystals.

The product was redissolved in chloroform, the solution was washed with water several times followed by the drying of the chloroform solution with anhydrous magnesium sulfate. The chloroform solution was filtered and the filtrate allowed to evaporate at room temperature to obtain a white solid. The solid was recrystallized from a benzene petroleum ether solution and allowed to dry at room temperature. The crystals obtained had a melting point between 101° C. and 106° C. NMR 1H ($CDCl_3$) δ7.53 ppm, δ7.74 ppm and δ7.90 ppm.

This reaction is as follows:

$$SbCl_3+3(C_6H_5)_4SnOH+3(Et_3)_3N \rightarrow Sb(OSn(C_6H_5)_3)_3 3(Et_3)_3\ NH^+Cl^-$$

EXAMPLE 5

This example demonstrates the effect of the passivating agent of the present invention on an FCC catalyst in the presence of high concentrations of both vanadium and nickel in the hydrocarbon feedstock. Activity tests for several catalysts were carried out, maintaining constant the nickel and vanadium levels at 1,000 ppm and 4,000 ppm respectively and varying the passivating agent to metal molar ratio in each catalyst.

A conventional FCC catalyst was used. The catalyst had characteristics as given below in Table 1.

TABLE 1

| | | |
|---|---|---|
| $Al_2O_3$ | 37 | % W |
| $SiO_2$ | 59 | % W |
| $Re_2O_3$ | 3 | % W |
| Surface area | 205 | $m^2/g$ |

A metal contaminant solution was prepared by dissolving 1.3 g of vanadium naphthenate (3.09% wt vanadium) and 0.22 g of nickel naphthenate (4.66% wt nickel) in 5.5 ml of xylene. A solution of the passivation agent compound was prepared by dissolving an amount of the compound, as prepared in Example 1, in 3 ml of xylene. The compound solution and contaminant solution were mixed so as to provide solutions having molar ratios of tin to vanadium of 0.2, 0.4, 0.6 and 0.8. Each solution was used to impregnate a fixed amount of FCC catalyst. The catalyst was impregnated as follows. Four samples of 10 g of fresh catalyst which had been previously calcined at 400° C. for 4 hours and allowed to cool at room temperature in a dry atmosphere were provided. A volume of each prepared solution was quickly added to a catalyst sample and mixed to obtain an even distribution. Following the impregnation, each catalyst was dried at 70° C., this was followed by a calcination at 450° C. for 3 hours after which the temperature was increased to 550° C. under continuous air flow for an additional 3 hours. The impregnated catalyst was then steamed at 760° C. with 100% steam for 4 hours. This procedure was followed for each sample, and simulates a conventional process for catalyst regeneration in situ in an FCC process.

Control samples were provided as well; one (A) having neither contaminate metals nor passivating agent, and another (B) having only contaminant metals and no passivating agent.

Microactivity tests (MAT) were performed for each sample according to ASTM D-3907. The feedstock used for the tests is described in Table 2.

TABLE 2

| | |
|---|---|
| Gravity | 25.2° API |
| Carbon Conradson | 0.043% W |
| Kinematic Viscosity at 200° F. | 1.67 cp |
| Saturated | 57.3% W |
| Aromatics | 40.1% W |
| Sulfur | 1.2% W |
| Nickel | 0.1 ppm |
| Vanadium | 0.4 ppm |
| Aniline | 172.5° F. |

The results of the assays are shown in Table 3.

TABLE 3

| Catalyst | Sn/V mol/mol | Conversion % V | Gasoline % V |
|---|---|---|---|
| A | 0 | 62 | 56 |
| B | 0 | 20 | 15 |
| C | 0.2 | 44 | 35 |
| D | 0.4 | 49 | 38 |
| E | 0.6 | 55 | 46 |
| F | 0.8 | 57 | 48 |

Table 3 shows the activity and gasoline yields of metal contaminated and steam deactivated catalyst. It can be observed that catalyst B, without the passivating agent and with the contaminant metals, obtained the lowest conversion and gasoline yield. Catalyst A shows the behavior of the catalyst with neither passivating agent nor contaminant metals, and exhibits the highest conversion and gasoline yield. In catalysts C,D,E and F the concentration of the passivating agent is increased while maintaining the nickel and vanadium concentration constant at 1,000 ppm and 4,000 ppm respectively. It can be observed that as the concentration of the passivating agent of the present invention increases, the conversion and the gasoline yields increase even at the relatively high concentrations of nickel and vanadium used. The presence of the compound of the present invention greatly reduces the negative effect of the contaminating metals on the catalyst thereby allowing a high production of gasoline under standard FCC conditions in the presence of high concentrations of contaminant metals such as nickel and vanadium. The presence of both tin and antimony in the compound appears to have a synergistic effect on the ability of the compound to minimize the effect of contaminating metals upon the FCC catalyst.

This invention may be embodied in other forms or carried out in other ways without departing from the spirit or essential characteristics thereof. The present embodiments are therefore to be considered as in all respects to be illustrative and not restrictive, the scope of the invention being indicated by the appended claims, and all changes which come within the meaning and range of equivalency are intended to be embraced therein.

What is claimed is:

1. An antimony and tin containing compound for passivating contaminant metals to which a catalyst is exposed during fluid catalytic cracking of hydrocarbons containing said contaminant metals, said compound having a composition as follows:

$$(R^*)_xSb(OSn(R^{**})_3)_n$$

wherein

R* and R** are aryl compounds having between 6 to 13 carbon atoms, wherein n=1, 2 or 3 and x=4 when n=1, x=3 when n=2, and x=0 when n=3.

2. A compound according to claim 1, wherein R* and R** have between 6 to 11 carbon atoms.

3. A compound according to claim 1, wherein R* and R** have between 6 to 10 carbon atoms.

4. A compound according to claim 1, wherein R* and R** are phenyl.

5. A compound according to claim 2, wherein said compound has a melting point of between about 70° C. to about 180° C.

6. A process for preparing an antimony and tin containing compound for passivating contaminant metals to which a catalyst is exposed during fluid catalytic cracking of hydrocarbons containing said contaminant metals wherein the process comprises reacting an antimony containing compound with a triaryl tin hydroxide compound in the presence of an alkylamine catalyst so as to form a reaction mixture containing said antimony and tin containing compound, and crystallizing said antimony and tin containing compound from said reaction mixture.

7. A process according to claim 6, wherein said antimony containing compound is selected from the group consisting of monohalogen tetraaryl antimony, dihalogen triaryl antimony, and trihalogen antimony.

8. A process according to claim 6, wherein halogen of said antimony-containing compound is selected from the group consisting of bromine, chlorine, fluorine and mixtures thereof.

9. A process according to claim 6, wherein said triaryl tin hydroxide compound is triphenyl tin hydroxide.

10. A process according to claim 6, wherein said alkylamine catalyst is triethylamine.

11. A process according to claim 6, wherein the crystallizing step includes the steps of:

filtering said reaction mixture to obtain a filtrate containing said compound;

concentrating said filtrate so as to obtain an oil;

dissolving said oil in a heated solvent to obtain a solution of oil and solvent; and cooling said solution of oil and solvent so as to obtain a precipitate of said antimony and tin containing compound.

12. A process according to claim 6, further including the step of dissolving said antimony-containing compound and said triaryl tin hydroxide compound in an organic solvent to obtain solutions of each compound, and mixing said solutions and said alkylamine catalyst before said reacting step.

13. A process according to claim 12, wherein said organic solvent is selected from the group consisting of carbon tetrachloride, anhydrous ether, methylene chloride and mixtures thereof.

14. A process according to claim 6, wherein said antimony containing compound is selected from the group consisting of alkoxy-tetraaryl-antimony, dialkoxy-triaryl-antimony and trialkoxy-antimony.

15. A process according to claim 14, wherein said antimony-containing compound is dimethoxy-triphenyl antimony.

16. A process for passivating the effect of contaminant metals in a hydrocarbon feedstock on a cracking catalyst used in fluid catalytic cracking of said hydrocarbon feedstock, comprising the steps of:

providing an antimony and tin containing compound having a composition as follows:

$$(R^*)_x Sb(OSn(R^{**})_3)_n$$

wherein

R* and R** are aryl compounds having between 6 to 13 carbon atoms, and wherein n =1, 2 or 3 and x=4 when n=1, x=3 when n=2, and x=0 when n=3;

providing a fluid catalytic cracking catalyst;

providing a hydrocarbon feedstock containing contaminant metals;

treating said feedstock with said catalyst in the presence of said compound; and maintaining a molar ratio of antimony and tin to contaminant metal of between about 0.01 to 10.0.

17. A process according to claim 16, wherein said contaminant metals include nickel, vanadium, iron, copper, chromium, and mixtures thereof.

18. A process according to claim 16, wherein said contaminant metals are nickel and vanadium.

19. A process according to claim 18, further including the step of maintaining a molar ratio of antimony to nickel of between about 0.1 to 2.0.

20. A process according to claim 18, further including the step of maintaining a molar ratio of antimony to nickel of between about 0.2 to 2.0.

21. A process according to claim 18, further including the step of maintaining a molar ratio of tin to vanadium of between about 0.1 to 1.0.

22. A process according to claim 18, further including the step of maintaining a molar ratio of tin to vanadium of between about 0.2 to 0.9.

23. A process according to claim 18, further including the step of maintaining a molar ratio of tin to vanadium of between about 0.3 to 0.8.

24. A process according to claim 16, wherein said catalyst is a zeolite type catalyst.

25. A process according to claim 16, further including the step of dissolving said compound in an organic solvent prior to said treating step.

26. A process according to claim 25, wherein said organic solvent is selected from the group consisting of benzene, toluene, cyclohexane, furanes, xylenes and mixtures thereof.

27. A process according to claim 16, wherein said compound is mixed with said feedstock.

28. A process according to claim 16, wherein said catalyst is impregnated with said compound.

* * * * *